US006364116B1

(12) United States Patent
Ng

(10) Patent No.: US 6,364,116 B1
(45) Date of Patent: Apr. 2, 2002

(54) JIGSAW PUZZLE CARRIER

(76) Inventor: Kai-Man Ng, 181 Pembroke Dr., Lake Forest, IL (US) 60045

( * ) Notice: Subject to any disclaimer, the term of this patent is extended or adjusted under 35 U.S.C. 154(b) by 0 days.

(21) Appl. No.: 09/708,952

(22) Filed: Nov. 9, 2000

(51) Int. Cl.[7] ..... B65D 85/20
(52) U.S. Cl. ..... 206/579; 206/315.1; 273/157 R
(58) Field of Search ..... 206/315.1, 575, 206/579, 523, 557, 558; 220/23.4, 23.6, 23.88; 273/157 A, 157 R, 148 R

(56) References Cited

U.S. PATENT DOCUMENTS 4,302,013 A * 11/1981 Kavis ..... 206/315.1
4,436,307 A * 3/1984 Caldwell ..... 206/315.1
4,486,018 A * 12/1984 Keller, Jr. ..... 206/315.1
4,552,361 A * 11/1985 LaFleur ..... 206/315.1
4,811,954 A * 3/1989 Hemmann ..... 206/315.1
5,624,118 A * 4/1997 Gottesman ..... 273/157 R
6,276,525 B1 * 8/2001 Kobeluch et al. ..... 206/315.1

* cited by examiner

*Primary Examiner*—Luan K. Bui

(57) ABSTRACT

A puzzle carrier for use in the assembly and transportation of jigsaw puzzles, including a base or assembly tray and a plurality of sorting trays. The plurality of sorting trays have in the aggregate the same dimensions as those of the assembly tray. Each tray has a peripheral edge extending ⅛" to 1" above the surface thereof and each is provided with a foam insert fitting within the peripheral edge and extending upwardly of the peripheral edge by ⅛" to 1". At least one edge of the assembly tray is removable to facilitate removal of a finished puzzle. When the sorting trays are placed on top of the assembly tray with the foam inserts in place, the assembly is inserted into a carrying case having a peripheral zipper closure. When closed, the carrying case holds the assembly and sorting trays, together under compression against the foam inserts, thus allowing transport of the puzzle, without shifting of the trays or the puzzle pieces.

5 Claims, 2 Drawing Sheets

FIG. 1
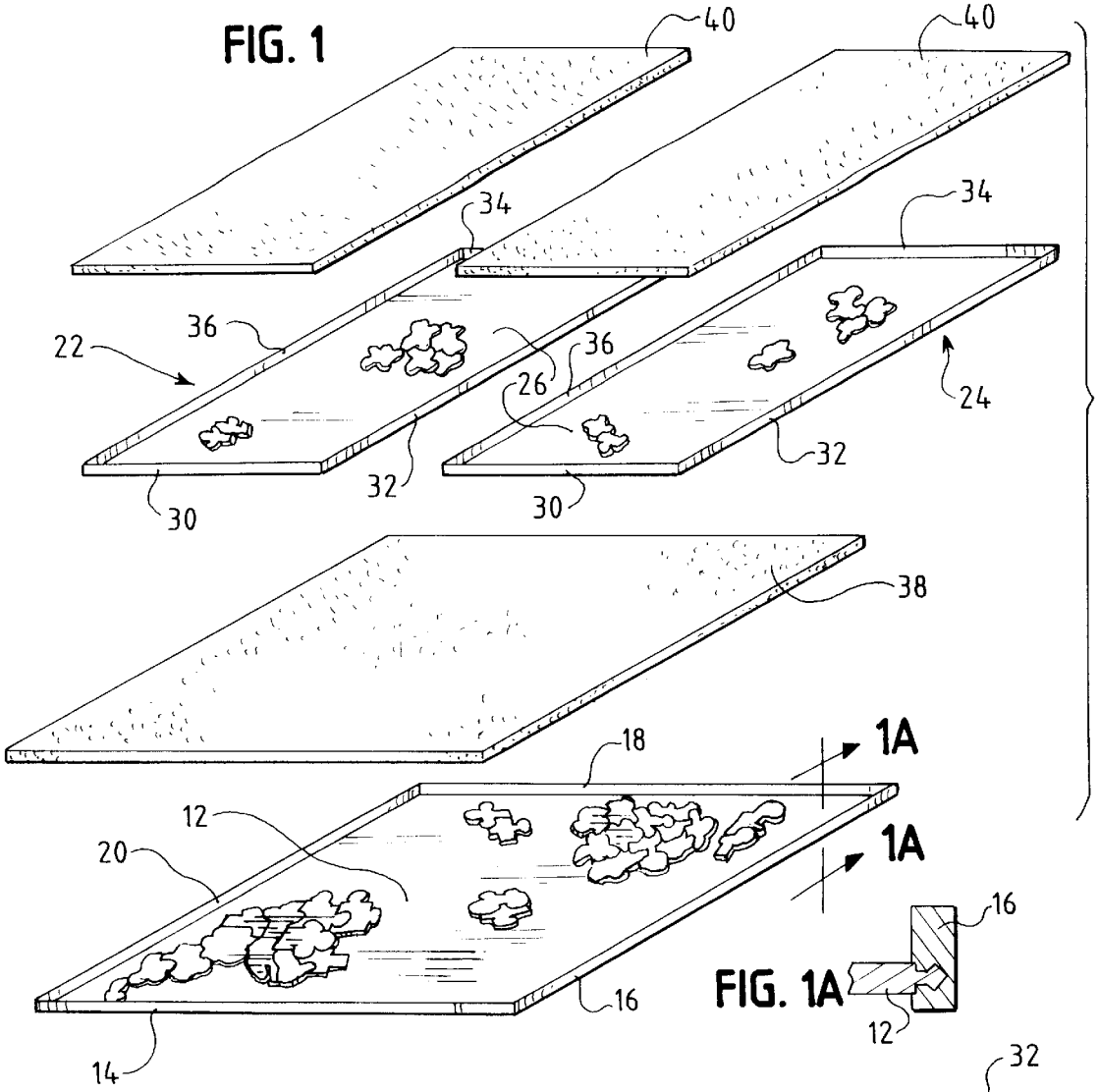
FIG. 1A
FIG. 2
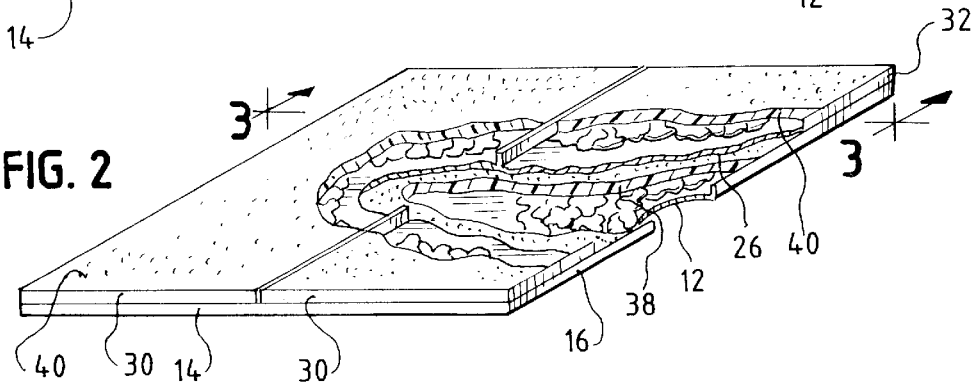
FIG. 3
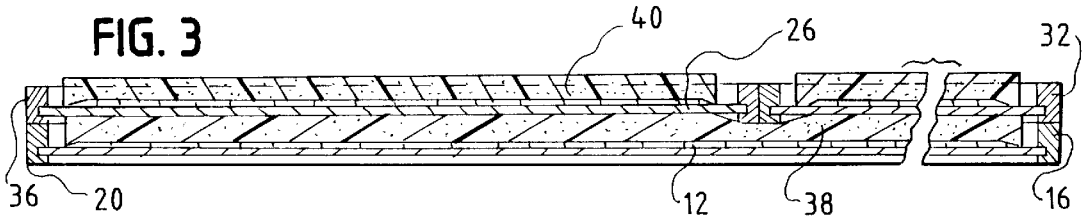

JIGSAW PUZZLE CARRIER

BACKGROUND OF THE INVENTION

1. Field of the Invention

The present invention relates generally to devices for use in connection with jigsaw puzzles, and more particularly to a puzzle carrier for sorting and assembling puzzle pieces and for carrying s and storing partially completed jigsaw puzzles in an orderly and protected manner.

2. Description of the Prior Art

Prior to the present invention, the prior art devices for use in the assembly, storage and transportation of jigsaw puzzles is represented by U.S. Pat. No. 4,436,307, which issued to Caldwell on Mar. 13, 1984. That device included an assembly tray and two storage trays, the latter fitting adjacent one another within the edges of the assembly tray. A carrying cover with rigid hinged panels was used to hold the assembled trays together during transport or storage of the puzzle.

In actual use, the Caldwell device exhibits several shortcomings. Specifically, the carrying cover is open at the ends and may permit the trays to slide outwardly thus risking loss of puzzle pieces during transport. Also, being formed of hinged rigid panels, the carrying case is cumbersome to use. Further, in order to remove a completed puzzle from the surface of the assembly tray, it is necessary to lift it over the peripheral edge. This task is quite difficult without at least partial disassembly of the completed puzzle.

OBJECTIVES AND SUMMARY OF THE INVENTION

From the preceding discussion, it will be understood that among the various objectives of the present invention are included the following:

The provision of a new and improved puzzle carrier for use in the assembly, storage and transport of jigsaw puzzles;

The provision of a device of the above-described character having an improved efficiency carrying case; and The provision of a device of the above-described character, wherein the assembly tray is provided with at least one removable peripheral edge to facilitate removal of a completed puzzle.

These, as well as other objectives of the present invention, are efficiently achieved by providing an assembly tray and a plurality of sorting trays. The plurality of sorting trays have in the aggregate the same dimensions as those of the assembly tray. Each tray has a peripheral edge and is provided with a foam insert which fits within and extends above the respective peripheral edges. The stacked trays are placed in a carrying case which is closed about its complete periphery. At least one of the peripheral edges of the assembly tray is removable such that a completed puzzle may easily be transferred off the assembly surface without inadvertent disassembly.

The foregoing as well as other objects, features and advantages of the present invention will become more apparent from the following detailed description taken in conjunction with the appended drawings.

BRIEF DESCRIPTION OF THE DRAWINGS

FIG. 1. is an exploded view of the assembly and sorting trays of the present invention, each with their respective foam insert.

FIG. 1A is a sectional view taken along line 1A—1A of FIG. 1;

FIG. 2. is a cross section view of an assembly tray of the present invention showing the removable edge thereof;

FIG. 3. is a cross section view of the trays, together with their respective foam inserts assembled for insertion in the carrying case.

DESCRIPTION OF THE PREFERRED EMBODIMENT

Figure 4:
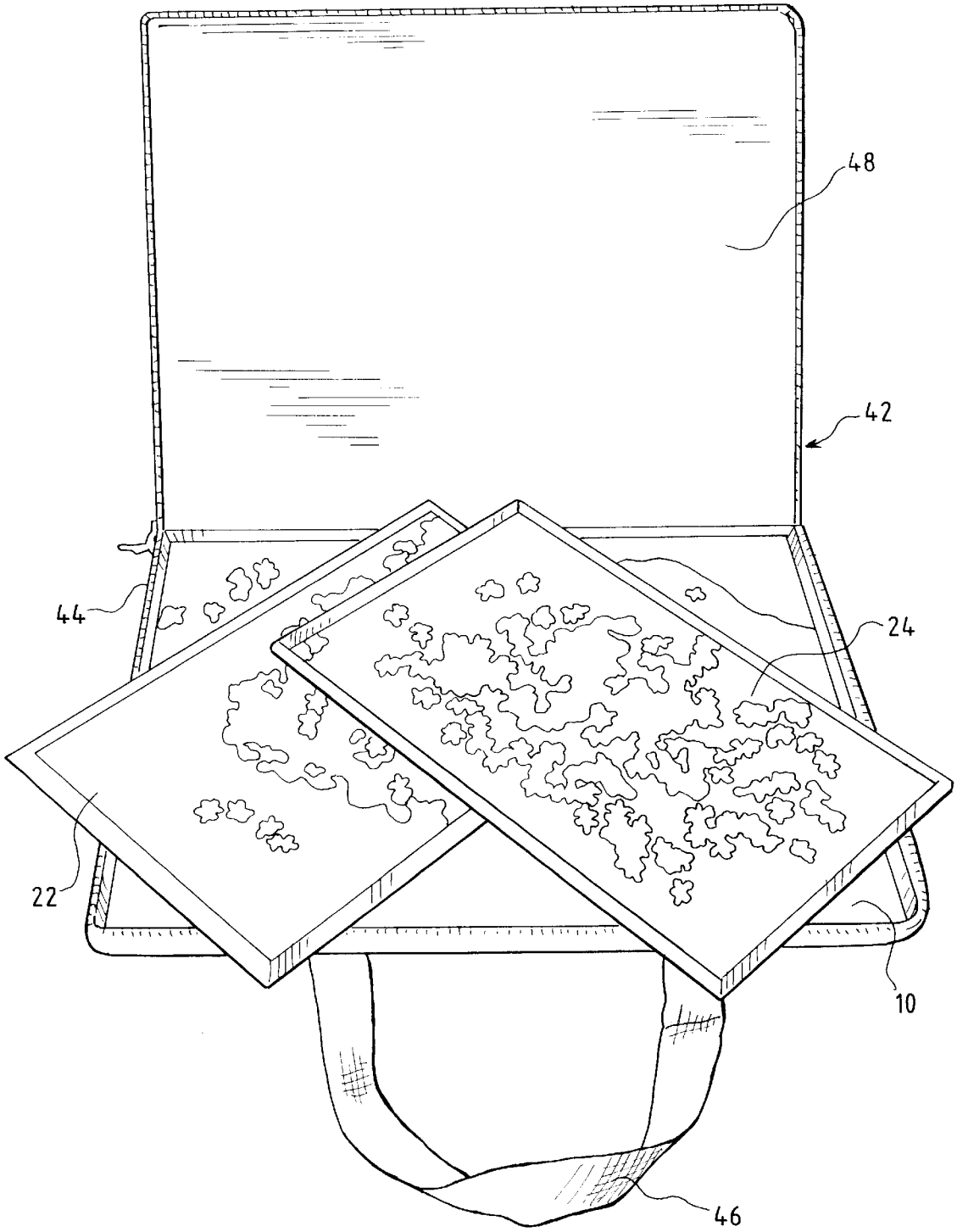
FIG. 4. Is a perspective view of the assembly tray, sorting trays and carrying case of the present invention.

With reference now to FIG. 1., there is shown in an exploded perspective view the trays of the present invention. An assembly tray 10 has a substantially flat bottom surface 12 having peripheral edges, 14, 16, 18 and 20. A plurality (two being shown for purposes of illustration) of sorting trays 22 and 24 having flat bottom surfaces 26 and 26' and peripheral edges 30, 32, 34 and 36, and 30', 32', 34' and 36' are also provided. In the aggregate, the outside dimensions of the sorting trays 22 and 24 (i.e. 30+30') equal those of the assembly tray 10 (i.e. 14).

The flat bottom surfaces 12, 26 and 26' are preferred to be of a neutral color in a matte finish to best display the puzzle pieces. The peripheral edges 14–20, 30–36 and 30'–36' of each tray 10, 22 and 24, respectively, extend upwardly of the respective surfaces 12, 26 and 26' by a distance of from ⅛" to 1" to prevent the accidental loss of loose puzzle pieces.

FIG. 1 A illustrates one embodiment of one edge 16 being removable from the bottom surface 12 of the assembly tray. A friction snap-on/off arrangement is shown, however, many alternative arrangements would be equally acceptable in the practice of the invention. The removable edge 16 allows a completed puzzle to be removed from the assembly tray to another surface, without having to lift and therefore risk disassembly of the puzzle.

Each tray 10, 22 and 24 are provided with a removable insert 38, 40 and 40', respectively, formed of a foam or other material having a compressible or sponge-like character.

FIG. 2. is a perspective view with portions cut away of the assembly tray 10 assembled with the sorting trays 22 and 24, wherein elements common to those show in FIG. 1. are identified by like reference characters. The foam insert 38 need not fit tightly against the peripheral edges 16 and 20 of the tray 10, and the applicant has found that a space of up to about ½" around the edges is not only adequate to retain the puzzle pieces in place, but also permits easy removal by the user. For efficient retention of the loose puzzle pieces in position within their respective trays during storage or transport, the applicant has found that the thickness of the foam insert 38 should be approximately twice the depth of the peripheral edges 16 and 20.

FIG. 3. shows in cross section the sorting trays 22 and 24 arranged with the assembly tray 10, each with their respective foam insert 38, 40 and 40' for placement in the carrying case (not shown). When the peripheral edges 32, 36, 32' and 36' of the sorting trays 22 and 24 rest against the peripheral edges 16 and 20 of the assembly tray 10, the foam insert 38 is compressed sufficiently against the surface 12 of the assembly tray to retain puzzle pieces in place during transport or storage.

FIG. 4. is a perspective view of a carrying case useful in the practice of the invention showing the stacked assembly of FIG. 3. in place and wherein like elements are identified by like reference characters. The carrying case 42 is generally rectangular, having horizontal dimensions substantially equal to those of the assembly tray 10 and a total depth substantially equal to the combined thickness of the peripheral edges of the stacked assembly of FIG. 3. The carrying case is closeable about its complete periphery preferably by a zipper closure 44, and may be provided with handles 46 (only one being shown). When the carrying case 42 is closed, the lid 48 operates to compress the foam inserts against the loose puzzle pieces in the sorting trays 22 and 24 thereby retaining them in position during transport or storage. The sorting trays 22 and 24, in turn, compress the foam insert against the loose puzzle pieces on the assembly tray 10. Depending upon the stiffness of the material used to fabricate the carrying case 42, a lining panel may be used in the lid 48 to improve compression of the foam inserts 40 and 40' against the loose puzzle pieces of the sorting trays 32 and 32' when the carrying case is zipped closed. The carrying case, being closed about its entire periphery prevents the trays from shifting with respect to one another and prevents inadvertent loss of the puzzle pieces.

From the foregoing, it will be understood that the applicant has provided a new and improved puzzle caddy for use in the assembly, transportation and storage of jigsaw puzzles in the process of assembly and wherein the objectives set forth herein are efficiently achieved. Since certain changes in the above-described construction will occur to those skilled in the art, without departure from the scope of the invention, it is intended that all matter set forth in the above description or shown in the various views of the appended drawings shall be interpreted as illustrative and not in limiting sense.

Having described what is new and novel and desired to secure by Letters Patent, what is claimed is:

1. A jigsaw puzzle carrier comprising a rectangular assembly tray having a substantially flat bottom surface and peripheral edges extending upwardly of said bottom surface, at least one of said peripheral edges being removably attached to said flat bottom surface;

a plurality of rectangular sorting trays each having a substantially flat bottom surface and peripheral edges extending upwardly of said bottom surface;

the aggregate outside dimensions of said sorting trays being substantially equal to the outside dimensions of said assembly tray such that when said sorting trays are placed adjacent one another on said assembly tray, the peripheral edges of the assembly and sorting trays are in substantial vertical alignment;

each of said assembly tray and said sorting trays being provided with a compressible insert having major dimensions selected to fit within the peripheral edges of each said tray and a thickness greater than the distance that the said peripheral edges extend upwardly of the respective flat bottom surfaces of each said tray; and a carrying case adapted to receive the said assembly tray, together with its respective compressible insert and the said plurality of sorting trays, each with its respective compressible insert, disposed on top of said assembly tray and having means for closing said case about its complete periphery;

whereby in its closed condition the said carrying case operates to compress the compressible inserts against the bottom surfaces of the respective trays and thereby retain any puzzle pieces in place during transport or storage.

2. A jigsaw puzzle carrier as defined in claim 1 wherein the peripheral edges of each of said assembly tray and sorting trays extend upwardly of the bottom surfaces by a distance in the range of from one-eighth inch to one inch.

3. A jigsaw puzzle carrier as defined in claim 1 wherein the compressible insert for each of said assembly tray and sorting trays has a thickness equal to twice the distance that the respective peripheral edges extend upwardly of the bottom surfaces of said trays.

4. A jigsaw puzzle carrier as defined in claim 1 wherein the closing means for said carrying case comprises a peripheral zipper.

5. A jigsaw puzzle carrier as defined in claim 1 wherein said flat bottom surfaces of said assembly tray and said sorting trays have a neutral color matte finish.

* * * * *